United States Patent [19]

Nohira et al.

[11] 4,005,692

[45] Feb. 1, 1977

[54] CARBURETOR ARRANGED FOR RECIRCULATING EXHAUST GASES

[75] Inventors: Hidetaka Nohira; Masatoshi Sugiura, both of Susono, Japan

[73] Assignee: Toyota Jidosha Kogyo Kabushiki Kaisha, Japan

[22] Filed: May 19, 1975

[21] Appl. No.: 578,752

Related U.S. Application Data

[63] Continuation of Ser. No. 481,323, June 20, 1974, abandoned.

[30] Foreign Application Priority Data

July 5, 1973 Japan ..... 48-75221

[52] U.S. Cl. ..... 123/119 A

[51] Int. Cl.[2] ..... F02M 25/06

[58] Field of Search ..... 123/119 A

[56] References Cited

UNITED STATES PATENTS

| | | | |
|---|---|---|---|
| 3,457,906 | 7/1969 | Daigh | 123/119 A |
| 3,465,736 | 9/1969 | Daigh et al. | 123/119 A |
| 3,513,816 | 5/1970 | Daigh | 123/119 A |
| 3,766,896 | 10/1973 | Buehler | 123/119 A |

*Primary Examiner*—Wendell E. Burns
*Attorney, Agent, or Firm*—Toren, McGeady and Stanger

[57] ABSTRACT

In a carburetor, a branch passage is connected to the fuel-air mixture passage for charging exhaust gases back into the fuel-air mixture. A control valve is positioned in the branch passage for regulating flow of the exhaust gases and a first spring biases the control valve into the closed position. A throttle valve in the fuel-air mixture passage is operatively coupled to the control valve by a linkage arrangement so that the two valves can be operated together. The linkage arrangement includes a second spring which permits movement of the throttle valve without corresponding movement of the control valve. Further, the linking arrangement provides a certain amount of play between the movement of the throttle valve and the control valve so that the operation of the control valve can be delayed relative to the opening movement of the throttle valve.

4 Claims, 4 Drawing Figures

CARBURETOR ARRANGED FOR RECIRCULATING EXHAUST GASES

This is a continuation of application Ser. No. 481,323 filed June 20, 1974, now abandoned of HIDETAKA NOHIRA and MASATOSHI SUGIURA.

BACKGROUND OF THE INVENTION

The present invention is directed to a carburetor in which a control valve for regulating the flow of exhaust gases to be charged into the carburetor is operatively coupled to the carburetor throttle valve.

One of the best known and effective methods for reducing the nitrogen oxide content in the exhaust gases discharged from an internal combustion engine is the so-called exhaust gas recirculation method in which exhaust gases are returned to the intake system of the carburetor to decrease the maximum combustion temperature and thereby reduce the production of nitrogen oxides. In automotive internal combustion engines, the output from the engine can be controlled in response to the degree of opening of a throttle valve within the carburetor. Accordingly, it is most desirable if a one-to-one relationship between the opening of the throttle valve and the opening of the control valve for regulating the flow rate of the recirculated exhaust gases to be charged into the engine can be established. To accomplish such a relationship, the throttle valve is operatively coupled to the control valve through a linkage arrangement, however, the problem exists that the control valve may be frozen in position when the ambient temperature is extremely low and, further, it often happens that the control valve malfunctions due to corrosion. If the control valve cannot be operated, the operation of the throttle valve for controlling engine output is also adversely affected with the result that the engine cannot be started or the operation of the engine cannot be controlled. Furthermore, there is the problem that when the engine is running under a low load and it is unnecessary to recirculate exhaust gases, the exhaust gases are nonetheless recirculated because the throttle valve is operatively coupled to the control valve.

SUMMARY OF THE INVENTION

The primary object of the present invention is to overcome the defects and disadvantages experienced in prior art carburetors which use exhaust gas recirculation. Briefly stated, in accordance with the present invention, though a malfunction of the control valve may develop, it is still possible to obtain proper operation of the throttle valve. Moreover, the timing of the control valve opening can be adjusted relative to the opening of the throttle valve so that the maximum effect of recirculation of the exhaust gases can be attained. The rotary shafts of the throttle valve and the control valve can be operatively coupled through a linkage arrangement including a spring which affords operation of the throttle valve without corresponding operation of the control valve. Further, the linkage arrangement can be constituted to provide the delayed timing of the control valve opening relative to the throttle valve opening.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DESCRIPTION OF THE PREFERRED EMBODIMENT

Figure 1:
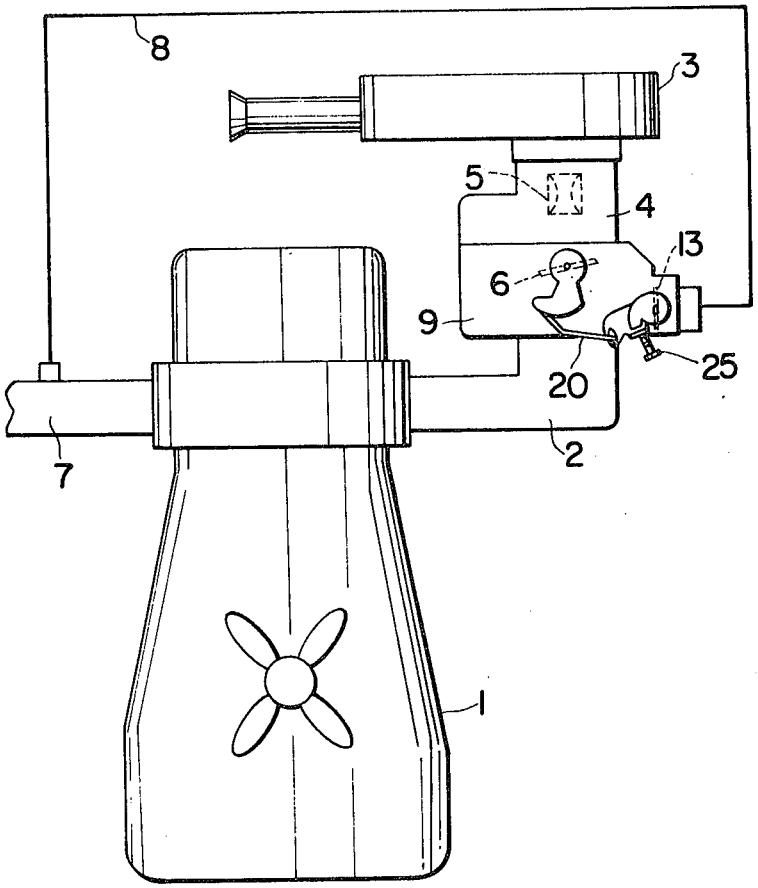
FIG. 1 is a schematic illustration of an internal combustion engine and a carburetor embodying the present invention.

In FIG. 1 an internal combustion engine body 1 has an intake manifold 2 which is supplied with a fuel-air mixture by means of an air cleaner 3 and a carburetor 4. Within the carburetor a venturi 5 is positioned between the air cleaner 3 and a throttle valve 6. After combustion of the fuel-air mixture within the engine body 1, exhaust gases are discharged from the engine body into the surrounding air through an exhaust manifold 7. A tube 8 is connected at one end to the exhaust manifold 7 and at its other end to the carburetor 4. A fuel-air mixture passage is formed by the carburetor and the tube 8 delivers the exhaust gases into the fuel-air mixture passage at a position downstream from the throtte valve 6, note FIG. 2.

Figure 2:
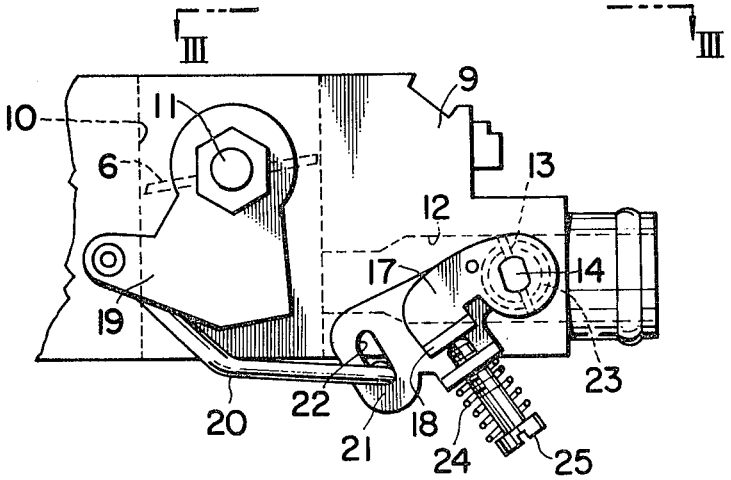
FIG. 2 is a partial view, on an enlarged scale, of the carburetor shown in FIG. 1.
Figure 3:
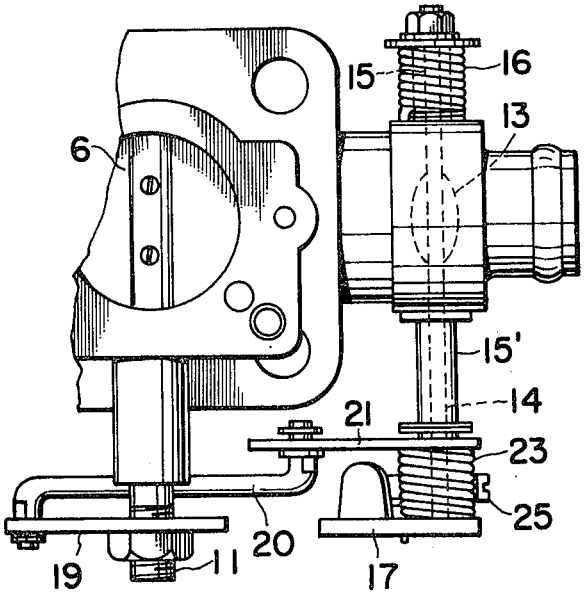
FIG. 3 is a partial view taken in the direction of the arrows III—III in FIG. 2.
Figure 4:
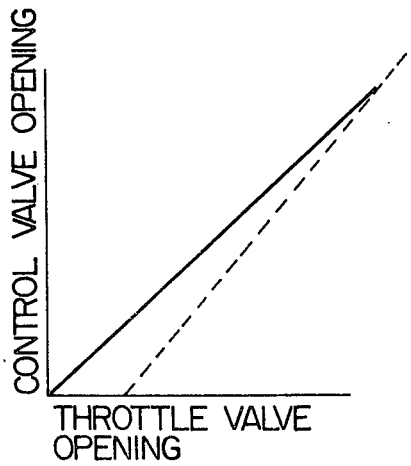
FIG. 4 is a graph illustrating the relation between the opening of the throttle valve and of the control valve for regulating the flow rate of the recirculated exhaust gases to be charged into the carburetor.

As shown in detail in FIGS. 2 and 3, the carburetor has a body 9 which forms a fuel-air mixture passage 10 containing the throttle valve 6. The throttle valve is rotatably supported on a shaft 11 mounted in the body 9. Accordingly, the flow rate of the fuel-air mixture through the carburetor is controlled by the throttle valve. The rotary shaft 11 of the throttle valve is operatively coupled to an acceleration pedal or the like, not shown, for regulating the flow of the fuel-air mixture to the engine.

Connecting the conduit or tube 8 to the fuel-air mixture passage 10 is a passage 12 located downstream of the throttle valve 6, note FIG. 1, so that exhaust gases can be charged into the fuel-air mixture passage. A control valve 13 is positioned within the passage 12 for controlling the rate of exhaust gases delivered into the passage 10. The control valve 13 is supported rotatably on a shaft 14 by a pair of bearings 15, 15′ located on the opposite ends of the shaft which extend from the body 9. As viewed in FIG. 3, a coiled spring 16 is positioned on the upper end of the shaft 14 and is connected between the shaft and the bearing 15 so that the control valve 13 is normally biased into the closed position. At the opposite end of the shaft, a cam 17 is attached to an extension of the bearing 15′ and an engaging plate or stopper, see FIG. 2, formed on the cam is arranged to provide engagement for an adjusting screw 25, to be described later.

Another cam 19 is attached to one end of the shaft 11 of the throttle valve 6 and is located exteriorly of the body 9. One end of a connecting rod 20 is pivotally connected to the cam 19 at a position spaced outwardly from the shaft 11 and the other end of the rod is loosely fitted into an elongated slot 22 in a follower cam 21 rotatably mounted on the bearing 15 at a position spaced inwardly from the cam 17. The follower cam 21 is coupled to the cam 17 attached to the shaft 14 of the control valve 13 by a coil spring 23 wound about the shaft. During operation, when the throttle valve 6 is rotated the follower cam is also rotated due to the interconnection provided by the connecting rod, and the rotation of the follower cam causes the spring 23 to become coiled around the shaft 14. As the spring 23 uncoils, the cam 17 is rotated causing both the shaft 14 and the control valve 13 which it mounts to rotate.

As can be seen in FIG. 2, a spring 24 is wound around the adjusting screw and extends between a bent portion of the follower cam 21 and the head of the adjusting screw. The bent portion of the follower cam is positioned opposite the engaging plate or stopper 18 on the cam 17. The relative positions or spacing between the stopper 18 and the bent-up portion of the cam 21 is determined by the extent to which the adjusting screw 25 is threaded through the bent-up portion into contact with the stopper. With the leading end of the adjusting screw 25 in contact with the stopper 18, note FIG. 2, as the adjusting screw is threaded through the bent-up portion of the cam 21 it causes the follower cam to rotate in the counterclockwise direction, since it is rotatably mounted on bearing 15' while the cam 17 is arranged to rotate with the shaft 14. Depending on the extent to which the stopper 18 and the bent-up portion of follower cam 21 are spaced apart, the end of the connecting rod 20 within the elongated slot 22 will be spaced from the end of the slot. Accordingly, as the throttle valve is opened there will be a delay until the connecting rod 20 contacts the end of the slot 22 to effect the rotary displacement of the follower cam 21 with the result that there is a delay between the opening of the throttle valve and the opening of the control valve 13.

The following is a description of the manner in which the carburetor operates.

As the throttle valve is rotated by the shaft 11, it is opened so that the flow rate of the fuel-air mixture is regulated as it flows to the engine to provide the desired output. At the same time, through the interconnection provided by the connecting rod 20, the control valve 13 is opened so that a regulated amount of the exhaust gases is introduced through the passage 12 into the fuel-air mixture passage 10. As viewed in FIG. 2, when the throttle valve 6 is opened, that is, when the cam 19 is rotated in the counterclockwise direction, the follower cam is also rotated in the counterclockwise direction via the connecting rod 20 so that the cam 17, coupled to the follower cam 21 by the spring 23 is also rotated in the counterclockwise direction. Therefore, the shaft 14 of the control valve 13 is rotated clockwise causing the control valve to open. Subsequently, when the throttle valve 6 is moved into its closed position, that is, when the cam is rotated clockwise, the connecting rod 20 is returned to its initial position and the follower cam is caused to rotate clockwise under the force of spring 23. Additionally, the cam 17 is arranged to be rotated as the stopper 18 pushes against the leading end of the adjusting screw 25. Thus, the control valve 13 is rotated, closing the passage 12, until the force of the spring 23 uncoiled by the force of the spring 16, which causes the control valve to close, is balanced. As a result, there is a one-to-one correspondence between the rotary displacements of the throttle valve 6 and the control valve 13.

When the ambient temperature is extremely low, the shaft 14 of the control valve 13 is frozen by water in the exhaust gases. Further, at times the operation of the control valve 13 is adversely affected by corrosive contaminants in the exhaust gases. Therefore, in accordance with the present invention, the rotary shaft 14 of the control valve 13 is coupled directly to the cam 17 and through the spring 23, the cam 21 and the connecting rod 20, is coupled to the cam 19 secured to the shaft 11 of the throttle valve 6. Through the spring 23 is coiled or uncoiled when the throttle valve is rotated, the control valve 13 may not rotate if it is frozen in position or is otherwise prevented from rotating. Accordingly, it is possible to assure the rotation of the throttle valve 6 even though the control valve 13 is held against rotation.

To adjust the relation between the output of the engine and the effect of the recirculation of exhaust gases, the engagement between the adjusting screw 25 and the stopper 18 is adjusted by threading the screw through the bent portion of the follower cam 21 causing the spacing between the bent portion of the follower cam and the stopper 18 on the other cam 17 to vary so that the elongated slot 22 is displaced relative to the end of the connecting rod 20. As the spacing between the stopper 18 and the bent portion of the follower cam 21 is increased the delay in the opening of the control valve 13 following that of the throttle valve 6 is correspondingly increased. Therefore, though the throttle valve 6 is opened and the connecting rod 20 is moved by the cam 19, the follower cam 21 does not commence rotation until the end of the connecting rod engages the end of the elongated slot 22 with the resultant delay in the opening of the control valve 13. When the connecting rod contacts the end of the slot 22, the rotation of the throttle valve 6 is transmitted through the cam 17 to the shaft 14 and, thus, to the control valve 13. In other words, the throttle valve is coupled to the control valve when the end of the connecting rod 20 contacts the end of the slot 22.

Therefore, due to the arrangement provided by the present invention, though the shaft 14 of the control valve 13 becomes frozen or stuck, the operation of the throttle valve 6 is ensured by the manner in which the follower cam 21 is connected to the cam 17 over the coil spring 23. Moreover, the manner in which the control valve opens for regulating the flow rate of the exhaust gases into the fuel-air mixture can be controlled by means of the adjusting screw 25.

While a specific embodiment of the invention has been shown and described in detail to illustrate the application of the inventive principles, it will be understood that the invention may be embodied otherwise without departing from such principles.

What is claimed is:

1. In a carburetor comprising a carburetor barrel forming a fuel-air mixture passage, a throttle valve located within said fuel-air mixture passage for controlling the flow of the mixture therethrough, said throttle valve including a first rotary shaft for supporting and moving said throttle valve between its closed and open positions, a venturi located upstream in the direction of flow through said fuel-air mixture from said throttle valve, means connected to said fuel-air mixture passage for recirculating exhaust gases into said fuel-air mixture passage, said means including a control valve for regulating the flow of exhaust gases into said fuel-air mixture passage, said control valve including a second rotary shaft for supporting and moving said control valve between its closed and open positions, wherein the improvement comprises a first spring connected to said second rotary shaft for biasing said control valve into the closed position, linkage means interconnecting said first rotary shaft and said second rotary shaft for coupling the operation of said throttle valve to said control valve for effecting a one-to-one correspondence between the rotary displacement of the throttle valve and the control valve and said linkage means includes a second spring for connecting said linkage means to said second rotary shaft so that said throttle valve can operate independently of said control valve so that said throttle valve can rotate though rotation of said control valve is prevented.

2. In a carburetor, as set forth in claim 1, wherein said linkage means includes a first linkage assembly connected to said throttle valve and a second linkage assembly connected to said second spring to control said control valve with said first linkage assembly being connected to said second linkage assembly with play provided in the connection therebetween so that the movement of said control valve from its closed position is delayed relative to the movement of said throttle valve from its closed position.

3. In a carburetor, as set forth in claim 2, wherein said first linkage assembly comprises a connecting rod secured to said first rotary shaft so that it follows the opening and closing movements of said throttle valve, said second linkage assembly comprises a first cam attached to said second shaft, a second cam rotatably mounted on said second shaft, said second cam having an elongated slot therein and said connecting rod being displaceably positioned within said slot, and adjusting means extending between said first and second cams for rotating said second cam relative to said first cam for displacing the end of said connecting rod within said slot for delaying the opening action of said control valve relative to said throttle valve.

4. In a carburetor, as set forth in claim 2, wherein said first linkage assembly comprises a third cam connected to said first rotary shaft, and a connecting rod pivoted to said third cam, a first bearing member on one end of said second rotary shaft and a second bearing member on the opposite end of said second rotary shaft with said control valve located on said second rotary shaft between said first and second bearing members, and first spring is a coil spring and is secured between said first bearing member and said second shaft, said second linkage assembly comprises a first cam attached to said second bearing member, a second cam rotatably mounted on said second bearing member and spaced in the axial direction of said second rotary shaft from said first cam, said second spring is a coil spring extending around said second bearing member between said first and second cams and coupling said first and second cams together, said second cam having an elongated slot therein and the opposite end of said connecting rod from said third cam is displaceably positioned within said slot, adjustment means extending between said first and second cams for rotating said second cam relative to said first cam for displacing the opposite end of said connecting rod through said slot for delaying the opening action of said control valve relative to said throttle valve, and said adjustment means including an adjustment screw threaded through said second cam into abutment with said first cam for angularly displacing said second cam about said rotary shaft relative to said first cam for displacing the opposite end of said connecting rod through said slot in said second cam for establishing and varying the delay between the movement of said throttle valve and said control valve.

* * * * *